United States Patent [19]

Allred, Jr.

[11] 4,219,160

[45] Aug. 26, 1980

[54] FLUID SPRAY NOZZLE HAVING LEAK RESISTANT SEALING MEANS

[75] Inventor: Roy H. Allred, Jr., Pleasant Garden, N.C.

[73] Assignee: General Electric Company, New York, N.Y.

[21] Appl. No.: 867,435

[22] Filed: Jan. 6, 1978

[51] Int. Cl.[2] ..... B05B 1/08

[52] U.S. Cl. ..... 239/447

[58] Field of Search ..... 239/443, 444, 445, 446, 239/447, 448, 449, 383, 381

[56] References Cited

U.S. PATENT DOCUMENTS

| | | | |
|---|---|---|---|
| 2,848,721 | 8/1958 | Fredrickson | 239/447 X |
| 3,128,791 | 4/1964 | Haessler et al. | 239/446 X |
| 3,455,332 | 7/1969 | Cornelius | 239/445 X |
| 3,722,798 | 3/1973 | Bletcher et al. | 239/445 X |
| 3,741,481 | 6/1973 | Bauer | 239/102 |
| 3,762,648 | 10/1973 | Deines et al. | 239/383 |
| 3,801,019 | 4/1974 | Trenary et al. | 239/383 |
| 3,958,756 | 5/1976 | Trenary et al. | 239/383 X |
| 3,967,783 | 7/1976 | Halsted et al. | 239/447 X |
| 4,117,979 | 10/1978 | Lagarelli et al. | 239/449 X |

FOREIGN PATENT DOCUMENTS

| | | | |
|---|---|---|---|
| 691779 | 5/1953 | United Kingdom | 239/444 |

*Primary Examiner*—Andres Kashnikow

*Attorney, Agent, or Firm*—George R. Powers; John F. Cullen; Leonard J. Platt

[57] ABSTRACT

A fluid spray nozzle of the massaging type for selectively producing pulsating and nonpulsating streams is provided with axially adjustable valve sealing arrangements for selectively opening and closing inlet ports. The axial flow directing and sealing means provides positive shut-off characteristics even after the various elements have been subjected to substantial wear.

6 Claims, 6 Drawing Figures

FLUID SPRAY NOZZLE HAVING LEAK RESISTANT SEALING MEANS

BACKGROUND OF THE INVENTION

1. Field of the Invention

This invention relates to fluid spray nozzles such as showerheads having means for adjustably dividing fluid flowing therethrough between pulsating and nonpulsating discharge streams and, more particularly, to fluid spray nozzles utilizing axial sealing arrangement having positive shut-off characteristics.

2. Description of the Prior Art

In recent years, specialized showerheads known as "massagers" have come into widespread use. Some of these spray nozzles are capable of producing a massaging action by, periodically blocking the flow through each of a number of spray discharge openings, the result being a number of pulsating jets which in combination produce a desired massaging action. Since the user may not always desire a massaging action when taking a shower, showerheads have been provided in the past with valve means for selectively providing not only a massaging action, but also a nonpulsating spray. Similarly, showerheads have been provided in the past with various valve constructions for dividing the total flow in any desired proportion between pulsating and nonpulsating sprays. In this manner, it has been possible to obtain a wide range of shower actions ranging from a heavy massaging action (pulsating flow only) to a totally nonpulsating (continuous jets) spray. The usual practice in such spray nozzles is to provide separate groups or sets of discharge outlets for the pulsating streams and the nonpulsating streams. As a result, fluid should be discharged from only one set of discharge outlets when a pure massaging action is desired and fluid should be discharged from only the other set of discharge openings when a pure nonpulsating action is desired. When, of course, a combined action is desired, fluid will be discharged simultaneously from both sets of discharge openings.

In prior art showerheads, it has been common to provide the desired valving by means of a pair of apertured, relatively movable flat plates. More particularly, it is common to provide a first flat, stationary plate having apertures therein leading to two different groups of discharge outlets. A second flat, apertured plate is mounted over the first plate, and control means are provided externally of the showerhead housing to move the second plate between a pair of extreme end positions. In one end position, apertures in the two plates are aligned so as to direct fluid to only one set of discharge outlets. In the other end position, apertures in the two plates are aligned so as to direct fluid to only the other set of discharge outlets. In intermediate positions of the second plate, the apertures are aligned sufficiently to direct portions of the fluid to all discharge openings, the relative proportions directed to each set of discharge opening depending upon the relative positions of the first and second flat plates. In practice, it is fairly common to experience leakage between the two plates such that there is some flow to the discharge outlets intended for pulsating spray when a continuous spray only is desired, and vice versa. This leakage is most pronounced and troublesome after prolonged use of the showerhead has resulted in slight wear of the washers or seals surrounding the apertures on the flat plates. This leakage is evident to the user in the form of an undesired discharge from the nozzle in a form, most typically heavy dripping, that does nothing to contribute to either pulsating or nonpulsating shower action.

SUMMARY OF THE INVENTION

It is therefore a primary object of this invention to provide a fluid spray nozzle of the massaging type having improved leak resistant sealing means.

Another object of this invention is to provide in a fluid spray nozzle of the massaging type improved sealing means which seal the pulsating and continuous flow passages effectively even after substantial use and wear of the sealing means.

Yet another object is to provide in a showerhead of the massaging type sealing means for effectively preventing over a prolonged period dripping of water from either group of discharge outlets when discharge is desired through only the other group of discharge outlets.

Briefly stated, in carrying out the invention in one form, a fluid spray nozzle having first and second passage means leading to respective first and second groups of discharge outlets and means within the second passage means for cyclically interrupting fluid flowing to the second group of discharge outlets to cause a pulsating fluid spray therefrom is provided with movably mounted valve means and first and second inlet ports communicating with an inlet plenum and respectively, with the first and second passage means. The movably mounted valve means includes first and second valve members axially aligned with the first and second ports respectively. The first valve member is mounted for axial movement between a first end position blocking the first port and a second end position axially spaced from the first port, and the second valve member is mounted for axial movement between a first end position axially spaced from the second port and a second end position blocking the second port. Control means is coupled to the valve means for adjustably positioning the valve means so as to thereby divide fluid flowing from the inlet plenum between the first and second groups of discharge outlets. By further aspects of the invention, the control means includes a control member accessible from the outside of the housing and movable between first and second end positions. Motion transmitting means is coupled to the control member and the valve means such that movement of the control member to its first end position simultaneously moves the first and second valve members to their respective first end positions and such that movement of the control member to its second end position simultaneously moves the first and second valve members to their respective second end positions. By a further aspect of the invention, sealing contact between the first port and the first valve member establishes the first end positions of the first and second valve member, and sealing contact between the second port and the second valve member establishes the second end positions of the first and second valve members.

In accordance with still further aspects of the invention, a pair of first inlet ports and a pair of second inlet ports are provided, and first and second valve assemblies are provided therewith. The valve assemblies are mounted on parallel axes and each is in axial alignment with one of the first pair of ports and one of the second pair of ports. The motion transmitting means includes a spur gear, and each of the first and second valve assemblies includes a gear rack which meshes with the spur gear such that movement of the control member causes equal and opposite movement of the valve assemblies along their respective axes.

BRIEF DESCRIPTION OF THE DRAWING

While the novel features of this invention are set forth with particularity in the appended claims, the invention, both as to organization and content, will be better understood and appreciated, along with other objects and features thereof, from the following detailed description taken in conjunction with the drawings, in which:

DETAILED DESCRIPTION

Figure 1:
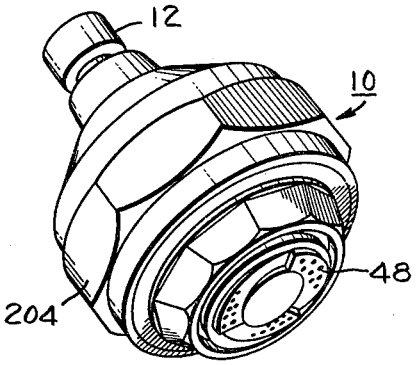
FIG. 1 is a perspective view of a showerhead embodying the present invention.
Figure 2:
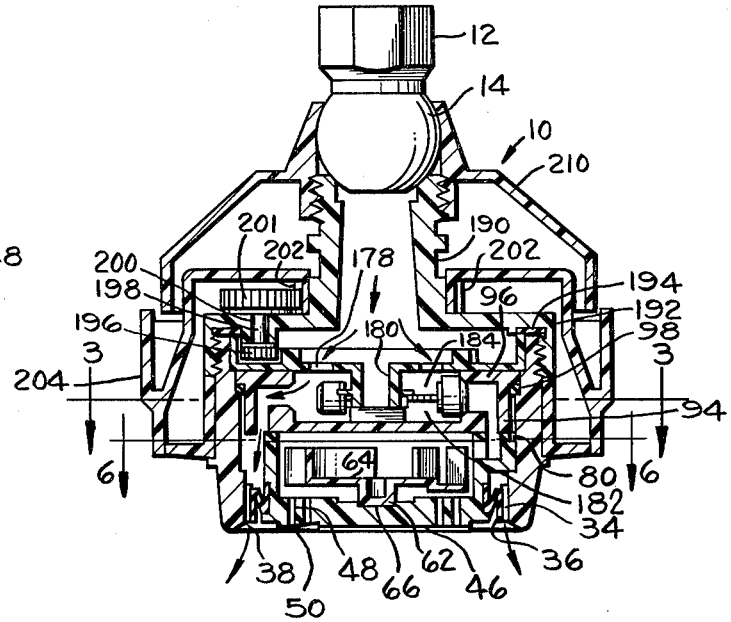
FIG. 2 is a cross-sectional view of the showerhead or fluid spray nozzle of FIG. 1.

Referring first to FIGS. 1 and 2, the invention is shown as being applied to a showerhead 10 adapted to be secured to a stationary supply pipe by means of an internally threaded pipe fitting 12, which includes a spherical end portion 14 upon which the showerhead 10 is secured for limited swivelling motion such that the person using the showerhead 10 may angularly direct it as desired. The showerhead or fluid spray nozzle 10 may alternatively be attached to the end of a flexible base to provide a hand held showerhead. The form of attachment forms no part of the present invention, and the present invention is equally applicable to stationary and hand held fluid spray nozzles.

Figure 5:
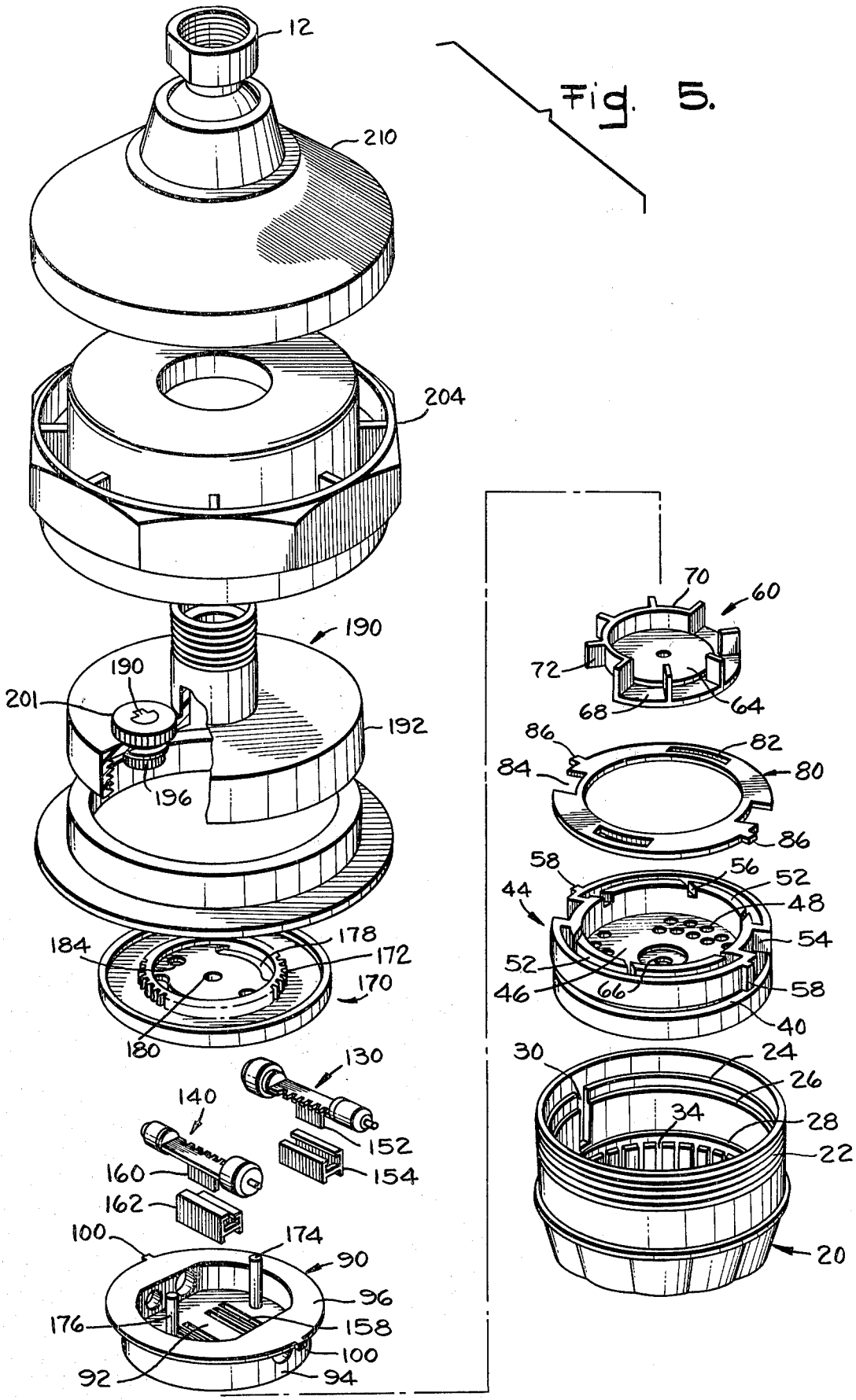
FIG. 5 is an exploded perspective view of the operating parts of the fluid spray nozzle of FIGS. 1 and 2.

Referring now to FIGS. 2 and 5, the fluid spray nozzle 10 includes a lower housing unit designated generally 20 of hollow tubular construction formed with an externally threaded neck 22 at its upper end. The internal central passage through the lower housing 22 is formed with three annular, radially extending shoulders 24, 26 and 28 which provide seating shoulders for axially locating other elements of the showerhead within the lower housing 20. Two diametrically opposite axial grooves 30, only one of which is illustrated by FIG. 5, extend downwardly from the shoulder 24 to shoulder 28 to angularly fix the position of other elements within the lower housing 20. The lower end of the central passage through the lower housing 20 is formed with a series of radially inwardly facing axial slots 34 uniformly spaced circumferentially about the inner surface of the housing unit 20. In the assembled showerhead, a washer 36 is seated to extend across the open radially inner sides of the slots or grooves 34 to form therewith a first group of spray discharge passages each terminating in an outlet 38 at the downstream end thereof.

Figure 6:
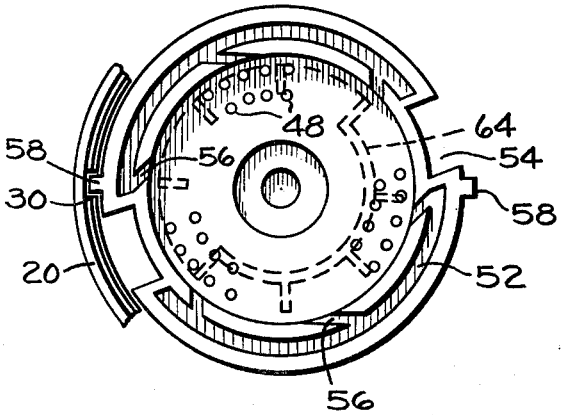
FIG. 6 is a view taken along viewing line 6—6 of FIG. 2 showing the spray cup and the fluid passageways leading to the first and second groups of discharge outlets and the rotor means for causing fluid flowing to the second group of discharge outlets to be pulsated.

The washer 36 is seated within an annular groove 40 in the cylindrical outer wall 42 of a spray cup 44, which has a generally flat lower end wall 46. The lower end wall 46 has three like groups of discharge passages 48 extending therethrough, each of which terminates at its downstream end in a spray discharge outlet 50. As best illustrated by FIG. 6, the three groups of discharge passages 48 lie in a symmetrical relationship within an annular band concentric with the central axis of the spray cup 44 and the end wall 46. As best shown by FIGS. 5 and 6, a pair of like flow carrying troughs 52 extend partially around the outer circumference of the spray cup 44 at its upper end in a symmetrically disposed relationship. The adjacent ends of the two troughs 50 terminate short of each other to provide a pair of axially extending passages 54 between the spray cup 44 and the inner surface of the housing 20, the passages 54 being diametrically opposed to each other. A plurality of tangentially directed passages 56 pass through the radially inner wall of each of the troughs 52 so that water flowing through the troughs is discharged tangentially into the central passage of the spray cup 44. As illustrated by FIG. 2, the exterior wall of the troughs 52 are seated upon the shoulder 28 of the lower housing 20 to axially locate the spray cup 44 within the housing, the cup being rotatively oriented within the housing 20 by a pair of projecting lugs 58 received within locating slots 30 of the housing 20. When the spray cup 44 is seated within the housing 20, the washer 36 is radially compressed against the grooves 34 to cause the grooves to define a first group of fluid spray discharge passages and outlets, while the discharge passages 48 in the end wall 46 form a second group of fluid spray discharge outlets.

A rotary valve member, designated generally as 60, rests upon the inner or upper side of the end wall 46 of the spray cup 44, and the valve member 60 is retained by the inner wall of the spray cup 44, within the central passage for rotation about the central axis of the unit. Rotation occurs about a stub shaft 62 which depends from the lower surface of a central flat circular plate portion 64, the shaft 62 being received in a mating recess 66 in the upper surface of lower wall 66 of the spray cup 44. The valve member further includes a flat generally C-shaped base plate portion 68 which is attached to and extends radially outwardly of the plate 64 about approximately 180° of its periphery. The upper surface of the C-shaped portion 68 is substantially aligned with the lower surface of the plate 64, and the lower surface of the portion 68 abuts the upper surface of the end wall 46. A semicylindrical portion 70 is integrally joined to the opposite ends of the portion 68 and the remaining periphery of the plate 64, the lower edge of the semicylindrical portion 70 being substantially coplanar with the lower edge of the plate 64 and the upper surface of the portion 68. A plurality of radially extending blades 72 are integrally mounted upon the outer surface of the semicylindrical portion 70 and the upper surface of the portion 68 in symmetrical relationship to the central axis of the unit.

Referring now to FIGS. 2 and 6, it will be noted that the C-shaped portion 68 rests on the inner surface of the end wall 46 of the spray cup 44 and is so located as to cover, at all times and rotative positions, at least a portion of the passages 48, the annular band within which the passages 48 lie corresponding in general to the annular path traversed by the portion 68 upon rotation of the valve rotor 60. Radial blades 72, as best seen by FIG. 2, are so located as to be struck by water discharged through tangential passages 56, and the valve rotor 60 is thus driven in rotation at a rate which varies with the rate of flow of water through the tangential passages 56.

Figure 3:
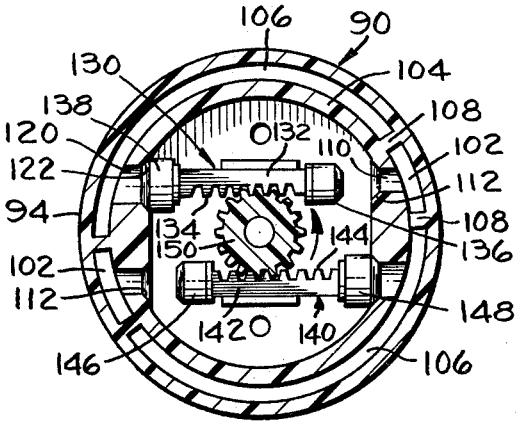
FIG. 3 is a view taken along viewing line 3—3 of FIG. 2 illustrating valve means constructed in accordance with the present invention positioned in first end positions.
Figure 4:
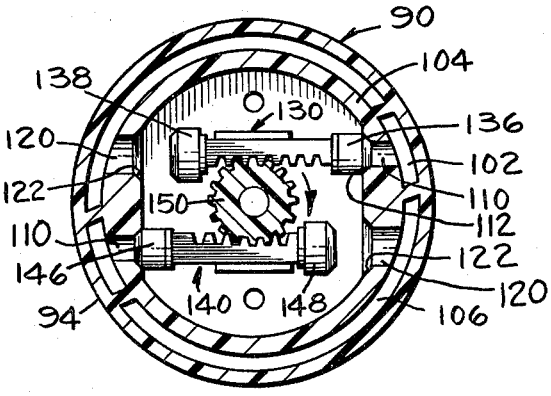
FIG. 4 is a view similar to FIG. 3 illustrating the valve means positioned in second end positions.

Referring now to FIGS. 2 through 5, a flat washer 80 is seated on the upper surface of the spray cup 44, the washer 80 having a pair of diametrically opposed slots 82 therein aligned with the troughs 52 in the spray cup 44 and a pair of diametrically opposed notches 84 aligned with the passages 54. The relative angular positions of the spray cup 44 and the washer 80 are maintained by the lugs 58 of spray cup and similar lugs 86 of the washer 80 received within the locating slots 30 of the housing 20. A flow directing member 90 having a generally flat lower wall 92 is seated upon the washer 80, the flow directing member 90 also having an outer cylindrical wall 94 nested within the lower housing 20 and an annular flat upper wall 96 projecting radially a sufficient distance from the wall 94 to trap a washer 98 between the lower surface of the wall 96 and the shoulder 26. The member 90 is thus located axially by the washer 80 and the shoulder 26 in combination with the washer 98, and the member 90 is angularly positioned by means of a pair of diametrically opposed lugs 100 which also mate with the locating slots 30. As best shown by FIGS. 3 through 5, the member 90 has a pair of diametrically opposed passages 102 therein located between the outer cylindrical wall 94 and a coaxial inner wall 104, the passages 102 being open at the bottom of the member 90 but closed at the top by the annular wall 96. Similarly, a pair of passages 106 of greater angular extent are also formed between the walls 94 and 104, these passages being separated from the passages 102 by webs 108 and also being open at the bottom of the member 90 and closed at the top by the wall 96. When the member 90 is positioned within the housing 20, the passages 102 are axially aligned with the passages 84 of the washer 80 and the passages 54 of the spray cup 44. Similarly, the passages 106 are aligned with the slots 82 of the washer 80 and the troughs 52 of the spray cup 44. The result of this alignment will become apparent as this description proceeds.

Referring now to FIGS. 2 through 5, a pair of passages 110 are provided through the inner wall 104 of the member 90 each of the passages 110 having a frustoconical part 112 at its end extending through the inner surface of the wall 104. The outer end of each of the passages 110 communicates with a respective one of the passages 102. A pair of substantially identical passages 120 each having a port 122 are provided through the wall 104 to provide communication to respective ones of the passages 106. One of the passages 110 and its port 112 is aligned with one of the passages 120 and its port 122 on a first axis with the ports 112 and 122 in spaced-apart facing relationship. The other passage 110 and its port 112 is similarly aligned with the other passage 120 and its port 122 on a second axis parallel to the first axis.

A first valve assembly 130 is mounted on the first axis for reciprocating movement between the respective ports. More particularly, the first valve assembly 130 includes a central portion 132 having a gear rack 134 thereon and a rubber plug end portion 136 sized to seat in the associated port 112 when the first valve assembly 130 is moved to a first end position (as shown by FIG. 4). The first valve assembly also includes a rubber plug end portion 138 sized to seat in the associated port 122 when the first valve assembly 130 is moved to a second end position (as shown by FIG. 3). A second valve assembly 140 is mounted on the second axis for reciprocating movement between the respective ports. As in the case of the first valve assembly 130, the second valve assembly includes a central portion 142 having a gear rack 144 thereon and a rubber plug end portion 146 sized to seat in the associated port 112 when the second valve assembly 140 is moved to a first end position (as shown by FIG. 4), and the second valve assembly 140 includes a rubber plug end portion 148 sized to seat in the associated port 122 when the second valve assembly 40 is moved to a second end position (as shown by FIG. 3). The racks 134 and 144 of the valve assemblies 130 and 140, respectively, face each other and mesh with opposite sides of a spur gear 150, which will be described presently in detail. The first valve assembly 130 is held in position by a depending guide element 152 received in a guide member 154, which in turn is snapped into locating slots 158 in the upper surface of the wall 92. The guide element 152 and the guide member 154 cooperate to hold the teeth of the rack 134 in contact with the spur gear 150 while permitting axial reciprocation of the valve assembly 130 in response to rotation of the spur gear 150. The second valve assembly 140 is similarly positioned by a depending guide element 160 and a guide member 162.

Still referring to FIGS. 2 through 5, the spur gear 150 is carried in a fixed position on the lower surface of a gear support plate 170 which carries on its upper surface a ring gear 172. When assembled, the studs 174 and 176 on the flow directing member 90 project upwardly through the arcuate slots 178 in the gear support plate 170. The gear support plate 170 and the first and second valve assemblies 130 and 140 are aligned when initially assembled such that clockwise rotation of the gear 150 (as illustrated by FIG. 4) will cause the valve assemblies 130 and 140 to move to the positions shown, in which the ports 112 are blocked by the end plugs 136 and 146, respectively. First end positions of the valve assemblies 130 and 140 are thus established by sealing engagement between the end plugs 136 and 146 and their associated ports 112. This same alignment of the gear support plate 170 and the valve assemblies also causes the ports 122 to be sealed by the plugs 138 and 148 when the spur gear 150 is rotated to its full counterclockwise extent (as illustrated by FIG. 3), thereby establishing second end positions for the first and second, valve assemblies 130 and 140. Since rotation of the spur gear 150 (and its supporting plate 170 and ring gear 172) causes equal and opposite rectilinear movement of the first and second valve assemblies along their respective axes, it will be seen that good sealing contact may be made between the end plugs 136, 138, 146 and 148 and their respective ports even if the plugs wear substantially during the life of the showerhead 10. As the plugs wear, the spur gear 150 will still be able to move the plugs into contact with the mating ports since it is the contact between the plugs and the ports that establishes the end positions of the first and second valve assemblies.

As best shown by FIG. 2, the gear support plate 170 has a passage 180 therein on the axis of the spur gear 150 and the ring gear 172, the passage 180 passing through the spur gear 150 to provide communication between the upper side of the support plate 170 and a plenum region 182 between the plate 170, the lower wall 92 of the flow directing member 90, and the inner wall 104 of the flow directing member 90. The gear support plate 170 also has some opening 184 and the slots 178 for providing communication from the upper side of the gear support plate 170 and the plenum region 182.

The individual parts described thus far are held in their assembled position by a connecting tube member designated generally 190 and having a depending annular skirt 192 which is internally threaded (see FIG. 2) to threadably receive the externally threaded upper end 22 of the lower housing unit 20 to which it is sealed by a washer 194. Rotation of the ring gear 172 and hence the gear plate 170 and the spur gear 150 is accomplished by a pinion gear 196 meshed with the ring gear 172. The pinion gear 196 has its shaft 198 rotatably received in a bore 200 in the connecting tube 190. A second gear 201 rotatably locked to the shaft 198 at the exterior of the connecting tube 190 is, in the assembled position, meshed with a gear 202 (FIG. 2) integrally formed on a control ring assembly 204 rotatably supported on the connecting tube 190. An upper housing unit 210 is threadably received upon the upper end of the connecting tube 190 and, when threaded onto tube 190, frictionally clamps the spherical end portion 14 of the pipe fitting 12. A skirt on the upper housing unit 210 also serves to axially confine the control ring 204.

The showerhead described above is operable to deliver three general types of sprays—an all-continuous spray in which all water discharged from the showerhead is discharged in continuous uninterrupted streams, an all-pulsating spray in which all water discharged from the showerhead is discharged in pulsating or cyclically interrupted streams, or a combination continuous-pulsating spray in which a portion of the water is discharged in continuous streams while the remaining portion is discharged as a pulsating cyclically interrupted spray. The showerhead, when discharging a combination spray, may be adjusted to selectively vary the proportioning of relative amounts of continuous spray to pulsating spray.

Referring to FIG. 2, it will be seen that, in the assembled unit, water from the supply pipe enters the showerhead 10 through the fitting 12 and enters the inlet plenum 182 through the connecting tube 190 (inlet) and the passages 180, 184 and 178 in the gear plate 170. From the inlet plenum 184, fluid can flow through two distinct passage means. More particularly, as shown by FIGS. 2–5, first fluid passage means extends from the first pair of inlet ports 112 through the flow passages 102, the notches 84, and the passages 54 to the first group of spray discharge passages terminating in the discharge openings 38. It will, of course, be obvious that fluid flows through this first fluid passage means only if the end plugs 136 and 146 are not fully seated in the ports 112. It will also be obvious that fluid flowing through this passage means is discharged from the discharge openings 38 as continuous uninterrupted streams.

A second fluid passage means extends from the second pair of inlet ports 122 through the passages 106, the slots 82, and the tangential passages 56 into the interior of the spray cup 44 to thus communicate with discharge openings 48. Fluid following this second fluid passage means impinges on blades 72 of the rotary valve member 60 as the fluid is discharged from the tangential passages 56, and thus the fluid drives the rotor 60 in rotation to cyclically interrupt the streams of fluid discharged from the openings 48 as the flat C-shaped portion 68 of the valve 60 rotates through overlying relationship with the individual ones of the openings 48. In other words, fluid is discharged at any given instant through only those openings 48 not covered by the C-shaped portion 68. Since the valve member 60 and the C-shaped portion rotate when fluid flows through the second passage means. The flow from the individual openings 48 is cyclically interrupted and thus provides a pulsating flow. It will be obvious that fluid flows through this second fluid flow passage means only if the end plugs 138 and 148 are not fully seated in the ports 122.

If a continuous spray only is desired, the control ring 204 is rotated about the showerhead 10 to an end position in which the motion transmitting means between it and the first and second valve assemblies moves the valve assemblies 130 and 140 to the position illustrated by FIG. 3. In this position, the plugs 138 and 148 completely seal the inlet ports 122 to force all fluid through the first passage means and out of the openings 38 as continuous streams. The motion transmitting means comprises in the illustrated embodiment the meshing gears 202 and 201, the shaft 198, the gears 196 and 172, the gear plate 170, and the gears 150, 134 and 144.

If an all-pulsating spray is desired, the control ring 204 is rotated in the opposite direction to an end position in which the motion transmitting means moves the first and second valve assemblies 130 and 140 to the positions illustrated by FIG. 4, in which the plugs 136 and 146 completely seal the inlet ports 112 to force all fluid through the second passage means and out the openings 48 as pulsating streams.

From the foregoing, it will be noted that the end positions of the various elements of the showerhead 10 are established by the abutment between the plugs 136, 138, 146 and 148 and the respective ports. As the plugs wear, the result will merely be slightly greater motion of the control ring 204 and the motion transmitting means. In this manner, good sealing is assured in spite of wear of the plugs. As a result, the valve arrangement of this invention is characterized by good sealing and a lack of leakage in the form of heavy dripping or the like.

If a combination continuous-pulsating spray is desired, the control ring 204 may be positioned at any point between its end positions, the relative proportions of the continuous portion of the total spray and the pulsating portion of the total spray being determined by the relative positions of the control ring 204 and the valve assemblies 130 and 140. If the ports 112 are just barely cracked while the ports 122 are still essentially wide open, the total fluid flow will be discharged primarily through the outlets 48 in the form of pulsating jets. Similarly, if the ports 122 are just barely cracked while the ports 112 are essentially wide open, the total fluid flow will be discharged primarily through the outlets 38 in the form of continuous jets. By placing the control ring 204 in its central position, the valve assemblies 130 and 140 will also be centrally located such that all of the inlet ports are open. In such a case, the total flow will be substantially equally divided between pulsating and continuous jets. To promote proportional flow in accordance with the relative position of the control ring 204, it has been found desirable in the illustrated embodiment to make the flow areas of the inlet ports 122 slightly larger than that of the ports 112, the respective end plugs being sized accordingly. This is, of course, a design feature which may vary in accordance with sizing of other components or other variations in structure consistent with the present invention.

While the invention has been particularly shown and described with reference to a preferred embodiment thereof, it will be understood by those skilled in the art that various changes in form, details, and application may be made therein without departing from the spirit and scope of the invention. Accordingly, it is intended that all such modifications and changes be included within the scope of the appended claims.

What is claimed as new and is desired to secure by Letters Patent of the United States is:

1. A fluid spray nozzle comprising:

a hollow housing having a fluid inlet, a first group of fluid spray discharge outlets, and a second group of fluid spray discharge outlets;

means in said housing defining an inlet plenum communicating with said fluid inlet, a first pair of inlet ports communicating with said inlet plenum, a second pair of inlet ports communicating with said inlet plenum, first passage means extending from said first pair of inlet ports to said first group of discharge openings, and second passage means extending from said second pair of inlet ports to said second group of discharge openings;

means within said second passage means responsive to fluid flowing through said second passage means to cyclically interrupt such fluid and cause a pulsating fluid spray to be discharged from said second group of discharge openings whenever fluid flows through said second passage means;

a first one of said first pair of ports and a first one of said second pair of ports aligned on a first axis in spaced-apart facing relationship, and a second one of said first pair of ports and a second one of said second pair of ports aligned on a second axis in spaced-apart facing relationship;

a first valve assembly mounted for reciprocating movement on said first axis between the respective ports, said first valve assembly being movable between a first end position blocking said first one of said first pair of ports and a second end position blocking said first one of said second pair of ports;

a second valve assembly mounted for reciprocating movement on said second axis between the respective ports, said second valve assembly being movable between a first end position blocking said second one of said first pair of ports and a second end position blocking said second one of said second pair of ports;

and control means coupled to said first and second valve assemblies for adjustably positioning said valve assemblies and thereby selectively dividing fluid flowing from said inlet between said first and second groups of outlet openings.

2. A fluid spray nozzle as defined by claim 1 in which control means comprises:

a control member accessible from the outside of the housing movable between first and second end positions;

and motion transmitting means coupled to said control member and to said first and second valve assemblies, said motion transmitting means aligned with said control member and said first and second valve assemblies such that movement of said control member to its first end position simultaneously moves said first and second valve assemblies to their respective first end positions and such that movement of said control member to its second end position simultaneously moves said first and second valves assemblies to their respective second end positions;

whereby fluid may be directed selectively through only said first group of outlet openings, only said second group of outlet openings, or proportionately divided between said first and second groups of openings 3. A fluid spray nozzle as defined by claim 2 in which each of said valve assemblies includes a pair of valve members each adapted to seat in the respective port to prevent fluid flow therethrough, and in which sealing contact between said first pair of ports and the respective valve members establishes the first end positions of said first and second valve assemblies and said control member, and in which sealing contact between said second pair of ports and the respective valve member establishes the second end positions of said first and second valve assemblies and said control member.

4. A fluid spray nozzle as defined by claim 2 in which said first and second axes are parallel, said motion transmitting means includes a spur gear, and said first and second valve assemblies include respective gear racks meshing with diametrically opposed sides of said spur gear such that movement of said control member causes equal and opposite movement of said valve assemblies along their respective axes.

5. A fluid spray nozzle as defined by claim 4 in which each of said valve assemblies includes a pair of valve members each adapted to seat in the respective port to prevent fluid flow therethrough, and in which sealing contact between said first pair of ports and the respective valve members establishes the first end positions of said first and second valve assemblies and said control member, and in which sealing contact between said second pair of ports and the respective valve members establishes the second end positions of said first and second valve assemblies and said control member.

6. A fluid spray nozzle as defined by claim 5 in which said second pair of ports have substantially greater flow area than said first pair of ports.

* * * * *